United States Patent [19]

Kakitani

[11] Patent Number: 5,073,745

[45] Date of Patent: Dec. 17, 1991

[54] INVERTER CIRCUIT FOR STABLE ILLUMINATION OF DISCHARGE LAMP

[75] Inventor: Tsutomu Kakitani, Yokohama, Japan

[73] Assignee: Toshiba Lighting and Technology Group, Tokyo, Japan

[21] Appl. No.: 589,585

[22] Filed: Sep. 28, 1990

[30] Foreign Application Priority Data

Sep. 29, 1989 [JP] Japan ..... 1-252331

[51] Int. Cl.[5] ..... H05B 41/24; H05B 41/36

[52] U.S. Cl. ..... 315/307; 315/155; 315/158; 315/209 R; 315/226; 315/DIG. 5; 315/DIG. 7

[58] Field of Search ..... 315/155, 159, 209 R, 315/226, 307, DIG. 2, DIG. 5, DIG. 7, 158

[56] References Cited

U.S. PATENT DOCUMENTS 4,562,383 12/1985 Kerscher et al. ..... 315/307 X

FOREIGN PATENT DOCUMENTS 380373 5/1986 Austria .
0126556 11/1984 European Pat. Off. .
189221 7/1986 European Pat. Off. .

*Primary Examiner*—David Mis
*Attorney, Agent, or Firm*—Cushman, Darby & Cushman

[57] ABSTRACT

The invention circuit for a discharge lamp comprising a first switching circuit, a series resonant circuit, and a current transformer. The series resonant circuit energizes the discharge lamp by means of resonant output corresponding to the output from the first switching circuit. The current transformer incorporates the first, second, and the third windings. When the first winding inserted in the series resonant circuit is driven, the first winding outputs a predetermined amount of current to the second and third windings. The inverter circuit further comprises a second switching circuit, a pair of time constant circuits, and a control circuit. The second switching circuit controls ON-OFF operation of the first switching circuit in response to the output from the second winding. A pair of time constant circuits respectively contains the predetermined time constant values, and based on the predetermined time constant, each of the time constant circuits controls the switching timing of the second switching circuit. The control circuit controls the time constant of these time constant circuits in response to the output from the third winding of the current transformer.

10 Claims, 4 Drawing Sheets

INVERTER CIRCUIT FOR STABLE ILLUMINATION OF DISCHARGE LAMP

BACKGROUND OF THE INVENTION

1. Field of the Invention

The present invention relates to an inverter circuit for controlling illumination of a discharge lamp.

2. Description of the Related Art

FIG. 1 designates a conventional inverter circuit of a discharge lamp. When the AC power is ON, transistors Q1 and Q2 of this inverter circuit are alternately turned ON and OFF in response to the output current from secondary windings N21 and N22 of a drive transformer DT, where operative timing of these transistors Q1 and Q2 is controlled by a time constant circuit which is composed of transistors Q3 and Q4 respectively being connected to the secondary windings N21 and N22, resistor R4, capacitor C5, resistor R6, and capacitor C6 respectively connected to bases of these transistors Q3 and Q4.

In response to the ON/OFF operations of the transistors Q1 and Q2, a capacitor C and a choke coil CH provided between filament electrodes Fl and F2 of a discharge lamp L respectively resonate themselves to cause the filament electrodes Fl and F2 to be pre-heated so that a high voltage can be generated at both terminals of the capacitor C. In consequence, the discharge lamp L lights up in a very short period of time after the power is ON.

Generally, in order to stably light up a discharge lamp, it is essential that the negative characteristic of the discharge lamp and the negative characteristic of the inverter circuit can cross each other at a sufficient angle.

Nevertheless, as shown in FIG. 2A, if it is so arranged that a constant-current characteristic be added to the negative characteristic INC of the inverter circuit, preheating secondary voltage tends to rise too high in the inverter circuit of the type mentioned above. In an extreme case, due to increased resonant current flowing through the inverter circuit, the inverter circuit itself may be destroyed.

On the other hand, if it is so arranged that the preheating secondary voltage be set to an optimal level, as shown in FIG. 2B, the negative characteristic INC of the inverter circuit deviates from the constant-current characteristic, and as a result, the negative characteristic INC cannot stably cross the negative characteristic LC of the discharge lamp. This in turn causes the discharge lamp to either flicker or turn OFF itself.

SUMMARY OF THE INVENTION

Therefore, the object of the invention is to provide an inverter circuit which is capable of lighting up a discharge lamp at an optimal condition.

To achieve the above object, the inverter circuit of the invention comprises the following;

first switching means;

a series resonant circuit for energizing a discharge lamp by applying resonant output signal corresponding to the signal output from said first switching means;

a current transformer having first, second, and third windings, and designed to output a predetermined signal to said second and third windings when said first winding is driven, said first winding inserted in said series resonant circuit;

second switching means for controlling ON-OFF operations of said first switching means in response to signal output from said second winding of said current transformer;

a time constant circuit, having a specific time constant, for controlling switching timing of said second switching means according to the specific time constant; and control means for controlling said time constant of said time constant circuit in response to signal output from said third winding of said current transformer.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Referring now to the accompanying drawings, an embodiment of the invention is described below.

Figure 3:
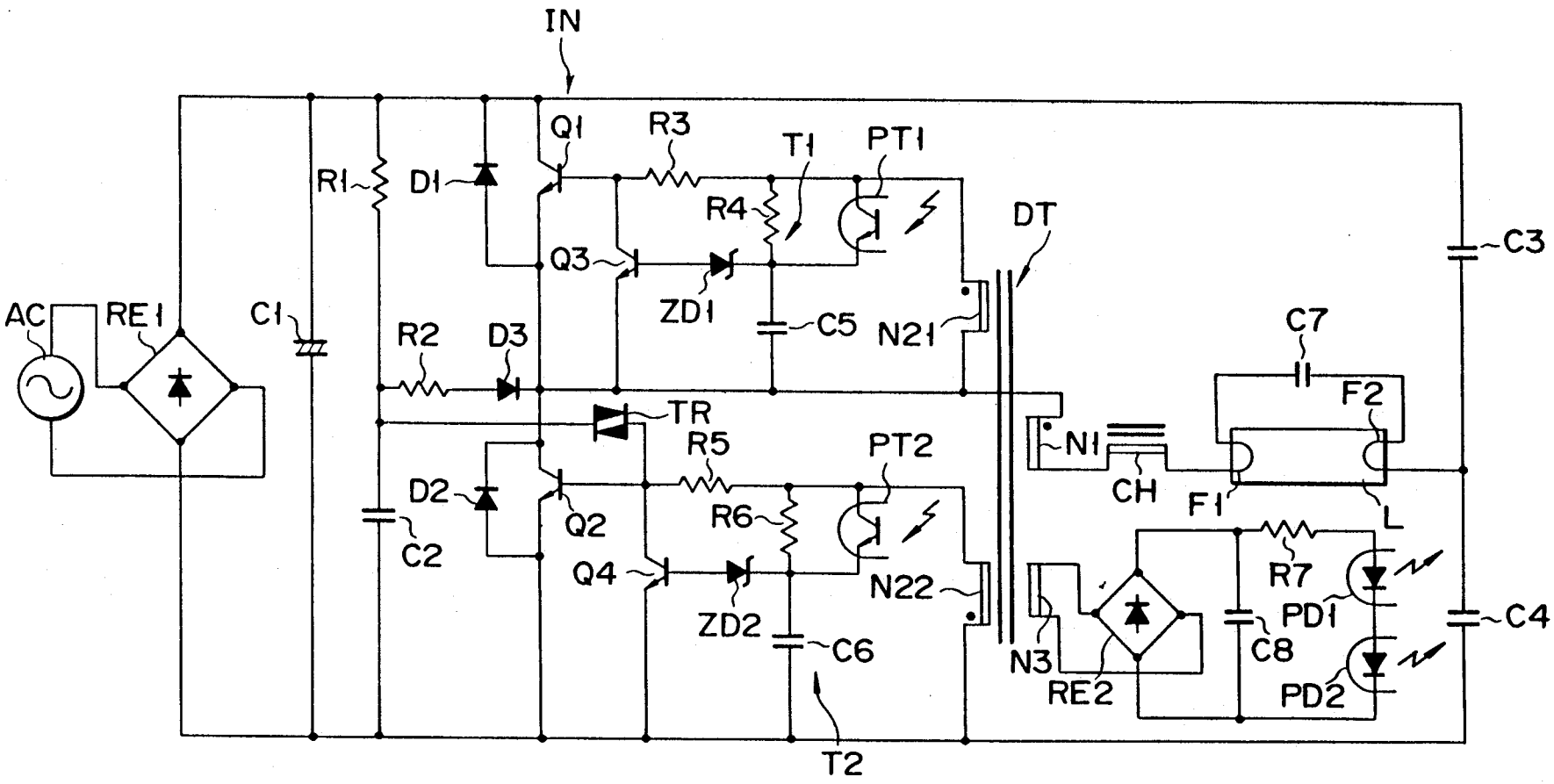
FIG. 3 is a concrete circuit block diagram of the inverter circuit according to an embodiment of the invention.

First, referring to FIG. 3, an AC power-supply source AC is connected to the input terminals of a rectifying circuit REl. A smoothing capacitor Cl is connected between the output terminals of the rectifying circuit REl. A series circuit composed of resistor R1 and capacitor C2 and transistors Q1 and Q2 which are connected to each other like totem-pole formation and compose an inverter circuit IN, and in addition, another series circuit composed of capacitors C3 and C4 for dividing supplied power, are respectively connected to both ends of the capacitor Cl. Diodes D1 and D2 are connected between collectors and emitters of those transistors Q1 and Q2. A resistor R2 and a diode D3 are connected in series between contact of these transistors Q1 and Q2 and another contact between the resistor Rl and the capacitor C2. A trigger diode TR which composes a circuit for activating the inverter circuit IN together with the resistor Rl and the capacitor C2 is connected between the contact of the resistor Rl and capacitor C2 and the base of the transistor Q2. Although this embodiment uses NPN type transistors Q1 and Q2, FETs may also be used.

The inverter circuit IN is composed of the following; the transistors Q1 and Q2; resistors R3 and R4, capacitor C5, resistors R5 and R6, capacitor C6 which are respectively connected between the bases and the collectors of those transistors Q1 and Q2; transistors Q3 and Q4 whose collectors and emitters are respectively connected between the bases and collectors of those transistors Q1 and Q2; Zener diodes ZDl and ZD2 which are respectively connected to the base of the transistor Q3 and the contact of the resistor R4 and capacitor C5 and the base of the transistor Q4 and the contact of the resistor R6 and capacitor C6; photo-transistors PT1 and PT2 which are respectively connected to the resistors R4 and R6 in parallel; and the drive transformer DT.

The drive transformer DT incorporates a primary winding N1, a pair of secondary windings N21 and N22, and a third winding N3. An end of the primary winding N1 is connected to an end of the secondary winding N21 and also to the contact of those transistors Q1 and Q2. The other end of the secondary winding N21 is connected to the contact of the resistors R3 and R4.

An end of the secondary winding N22 is connected to the contact of the resistors R5 and R6, whereas the other end is connected to the emitter of the transistor Q2.

The other end of the primary winding Nl is connected to a terminal of a filament electrode Fl of a discharge lamp L via a choke coil CH. The other terminal of this filament electrode Fl is connected to a terminal of the other filament electrode F2 via a resonant capacitor C7. The other terminal of this filament electrode F2 is connected to the contact of those capacitors C3 and C4.

The third winding N3 is connected to the input terminal of a rectifying circuit RE2. A smoothing capacitor C8 is connected to the output terminal of the rectifying circuit RE2. In addition, a series circuit composed of a resistor R7 and a pair of LEDs PD1 and PD2 is also connected to the output terminal of the rectifying circuit RE2. These LEDs PD1 and PD2 respectively make up photocouplers PC1 and PC2 together with those photo-transistors PT1 and PT2.

Next, functional operation of those structural components is described below.

When the AC power-supply source AC is ON, the transistor Q2 is activated via the trigger diode TR which composes the inverter-actuating circuit. This allows formation of a closed circuit composed of the transistor Q2, the capacitors C4 and C7, the choke coil CH, and the primary winding Nl of the drive transformer DT, thus causing current to flow through the closed circuit. When current flows through the primary winding Nl of the drive transformer DT, current generated in the secondary windings N21 and N22 causes the transistor Q2 to turn OFF and the transistor Q1 to turn ON. As a result, another closed circuit is formed by the transistor Q1, the capacitors C3 and C7, the choke coil CH, and the primary winding Nl of the drive transformer DT. This causes current to flow through this closed circuit in the direction inverse from the former closed circuit, and as a result, the transistor Q1 turns OFF and the transistor Q2 ON.

The ON-OFF timing of the transistors Q1 and Q2 is controlled by a time constant circuit T1 composed of the resistor R4 and the capacitor C5, another time constant circuit T2 composed of the resistor R6 and the capacitor C6, and the transistors Q3 and Q4.

With alternate switching operation between the transistors Q1 and Q2, the choke coil CH and the capacitor C7 resonate themselves in series to preliminarily heat the filament electrodes Fl and F2.

When current flows through the primary winding Nl of the drive transformer DT, current is induced in the third winding N3. The current induced by the third primary winding N3 is rectified by the rectifying circuit RE2. The rectified current is then smoothed by the capacitor C8, and then the smoothed current is transmitted to the LEDs PD1 and PD2 via the resistor R7. The light emitted from these LEDs PD1 and PD2 is received by the photo-transistors PT1 and PT2. Therefore, the current output from these photo-transistors PT1 and PT2 varies the time constant values of the time constant circuit T1 composed of the resistor R4 and the capacitor connected to these photo-transistors PT1 and PT2 and the other time constant circuit T2 composed of the resistor R6 and the capacitor C6. More particularly, when the amount of resonant current output from the drive transformer DT increases, the inverter circuit IN oscillates a higher frequency. This in turn prevents the secondary voltage for preheating the discharge lamp L from abnormally rising.

Based on those functional operations mentioned above, a high voltage is generated at both ends of the capacitor C7 to allow the discharge lamp L to light up in a short period of time after the power is ON.

According to the above embodiment, the time constant circuit T1 composed of the resistor R4 and the capacitor C5 connected to the bases of the transistors Q3 and Q4 and the other time constant circuit T2 composed of the resistor R6 and the capacitor C6 are respectively provided with the photocouplers PC1 and PC2 guiding the current output from the third winding N3 of the drive transformer DT. Time constant values of the time constant circuits T1 and T2 are respectively controlled in correspondence with the current output from the third winding N3 of the drive transformer via these photocouplers PC1 and PC2. As a result, the secondary voltage for preheating the discharge lamp can properly be set to stably and securely light up the discharge lamp.

Figure 1:
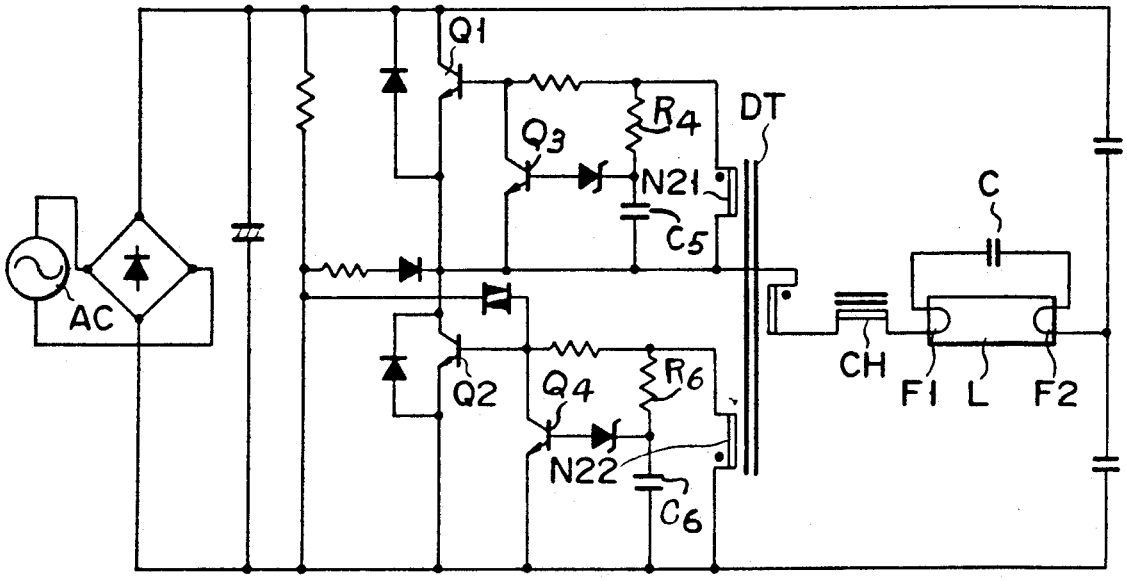
FIG. 1 (PRIOR ART)
FIG. 1 is a detailed block diagram of a conventional inverter circuit.
Figure 2A:
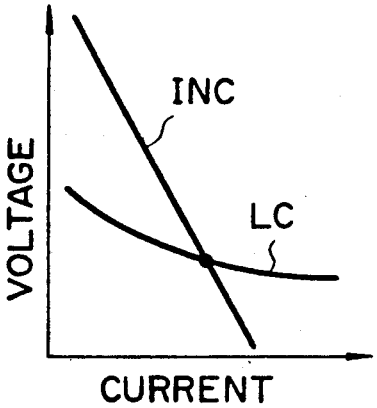
FIG. 2A (PRIOR ART)
FIGS. 2A and 2B respectively illustrate characteristics of a conventional inverter circuit shown in FIG. 1 for explaining its operation.
Figure 2B:
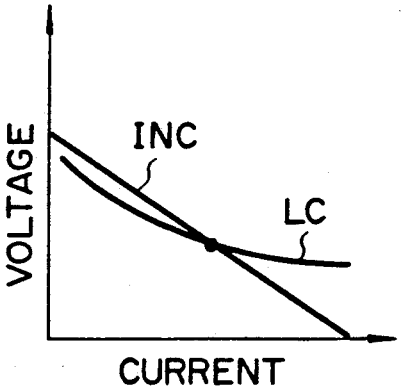
FIG. 2B (PRIOR ART)
Figure 4:
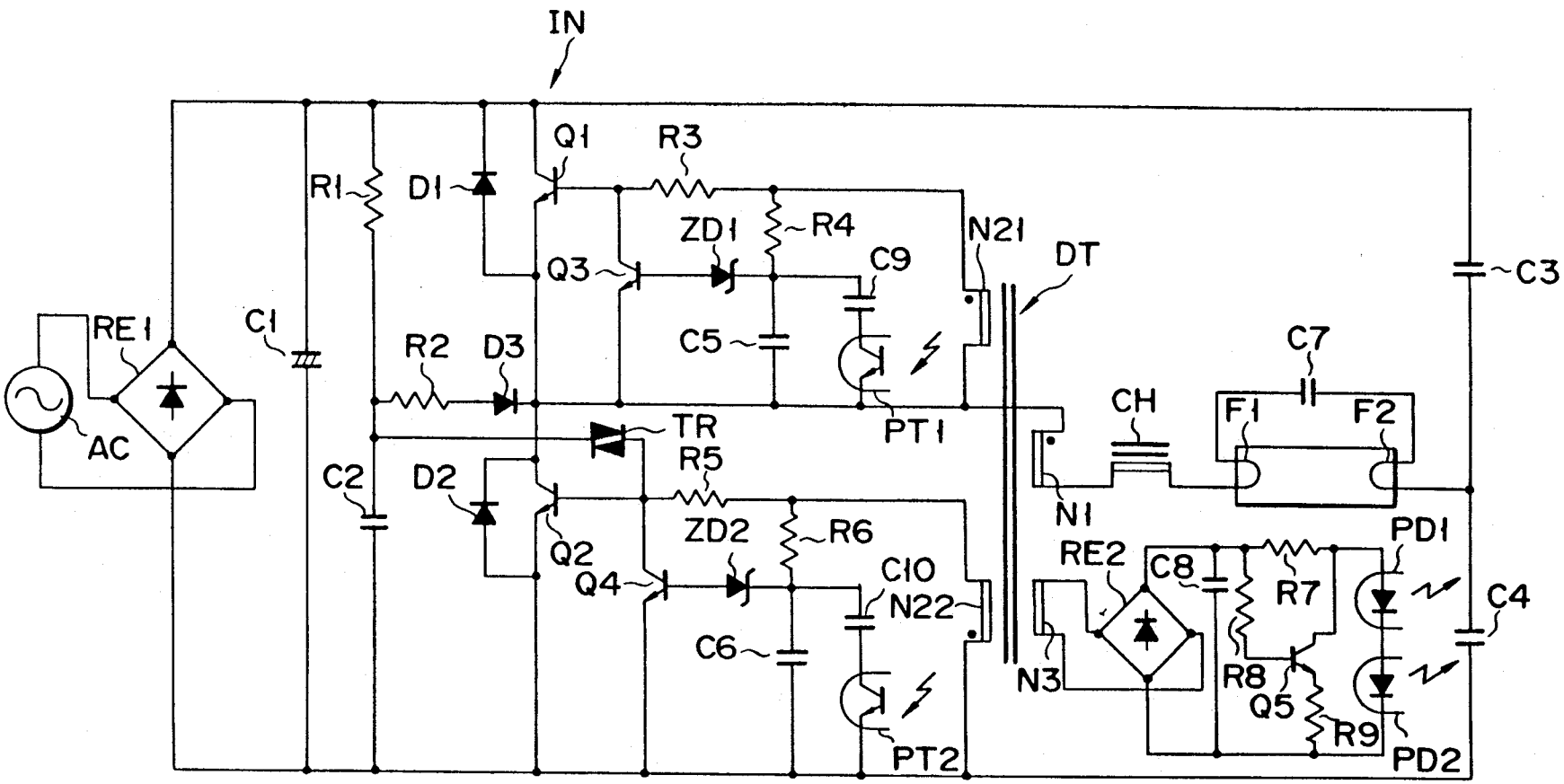
FIG. 4 is a concrete circuit block diagram of another embodiment of the inverter circuit related to the invention.

FIG. 4 designates the second embodiment of the invention. Those components identical to those of FIG. 1 are designated by the identical reference numerals. Only the different points are described below.

The first embodiment provides the photo-transistors PT1 and PT2 in parallel with those resistors R4 and R6 composing the time constant circuit T1 and T2. On the other hand, in the second embodiment, a series circuit composed of the capacitor C9 and the photo-transistor PT1 is connected to the capacitor C5 composing the time constant circuits T1 and T2 in parallel, and in addition, another series circuit composed of the capacitor C10 and the photo-transistors PT2 is connected in parallel.

Furthermore, a stabilization circuit composed of the resistors R8 and R9 and the transistor Q5 is connected to the output terminal of the smoothing capacitor C8 provided for the third winding N3 of the drive transformer DT.

The invention provides identical effect not only for the "half-bridge" type inverter, but also for such an inverter circuit of one-chip type transistor incorporating series resonant circuits. The above structure of the second embodiment securely achieves distinct effect identical to that of the first embodiment.

Figure 5:
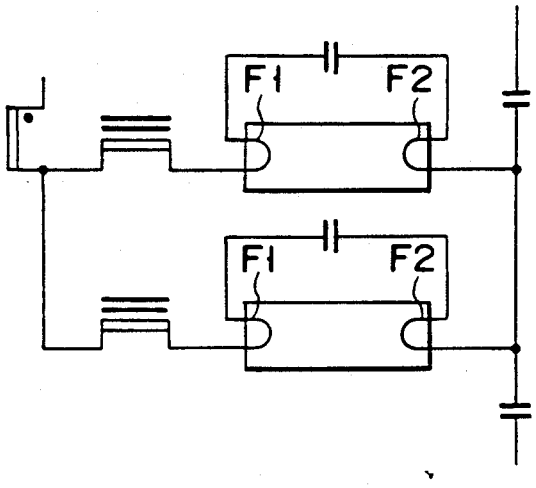
FIGS. 5 and 6 respectively designate partial modifications of the inverter circuit shown in FIG. 3.
Figure 6:
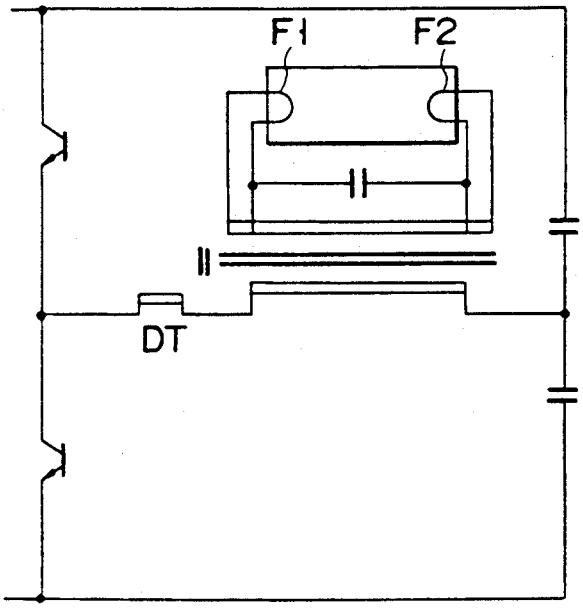

Furthermore, needless to say that a variety of modifications ca also be embodied by the invention in a range without departing from the scope of the invention. For example, as shown in FIG. 5, the invention is effectively applicable to the structure having a plurality of discharge lamps L connected in parallel, or an insulative transformer shown in FIG. 6 as well.

As is clear from the above description, according to the invention, in correspondence with current output from the third winding of the drive transformer, time constant of the time constant circuits built in the third and fourth switching systems controlling the operations of the first and second switching systems, is properly controlled. As a result, the secondary voltage for preheating the discharge lamp can adequately be set. Thus, the invention provides a reliable inverter circuit that can stably and securely light up a discharge lamp.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An inverter circuit for a discharge lamp, comprising:

first switching means for supplying a resonant output signal; and a series resonant circuit for energizing a discharge lamp by applying said resonant output signal from said first switching means; and a current transformer having first, second, and third windings, and designed to output a predetermined signal to said second and third windings when said first winding is driven, said first winding inserted in said series resonant circuit; and second switching means for controlling ON-OFF operations of said first switching means in response to signal output from said second windings of said current transformer; and a time constant circuit, having a specific time constant, for controlling switching timing of said second switching means according to the specific time constant; and control means for controlling said time constant of said time constant circuit in response to signal output from said third winding of said current transformer.

2. The inverter circuit according to claim 1, wherein said control means comprises a rectifying circuit for rectifying current output from said third winding and a photocoupler having a light emitting diode and a phototransistor for transmitting corresponding current to said time constant circuit, on receipt of a rectified output from said rectifying circuit.

3. The inverter circuit according to claim 2, wherein said time constant circuit comprises a series circuit composed of a resistor and a capacitor, and said photo-transistor is connected to said resistor in parallel.

4. The inverter circuit according to claim 2, wherein said time constant circuit comprises a series circuit composed of a resistor and a capacitor, and said photo-transistor is connected to said capacitor in parallel.

5. The inverter circuit according to claim 4, wherein said time constant circuit further comprises a capacitor connected to said photo-transistor in series.

6. The inverter circuit according to claim 2, wherein said control means comprises a smoothing capacitor connected to said rectifying circuit in parallel.

7. The inverter circuit according to claim 6, wherein said control means comprises a stabilization circuit connected to said smoothing capacitor in parallel.

8. The inverter circuit according to claim 7, wherein said stabilization circuit comprises a series circuit composed of a resistor and a transistor.

9. The inverter circuit according to claim 2, wherein said time constant circuit comprises a series circuit composed of a resistor and a capacitor, and said photo-transistor is connected to said capacitor in parallel, and said control means comprises a smoothing capacitor connected to said rectifying circuit in parallel and a stabilization circuit connected to said smoothing capacitor in parallel.

10. The inverter circuit according to claim 9, wherein said stabilization circuit comprises a series circuit composed of a resistor and a transistor.

* * * * *